United States Patent [19]

Menke et al.

[11] Patent Number: 4,636,132

[45] Date of Patent: Jan. 13, 1987

[54] VEHICLE BOOM LOCK

[75] Inventors: Jeffery W. Menke, Peoria; Craig W. Riediger, Pekin, both of Ill.

[73] Assignee: Caterpillar Inc., Peoria, Ill.

[21] Appl. No.: 739,505

[22] Filed: May 31, 1985

Related U.S. Application Data

[63] Continuation of Ser. No. 501,041, Jun. 6, 1983, abandoned.

[51] Int. Cl.[4] ..... B66C 23/00

[52] U.S. Cl. ..... 414/694; 298/17 B

[58] Field of Search ..... 414/685, 722, 680, 687, 414/686, 694; 212/189; 280/474; 403/164, 165, 360, 354, 321, 322; 298/17 B; 172/272–275; 24/115 G, 128, 130, 135 A, 136 A, 129 R, 114.5

[56] References Cited

U.S. PATENT DOCUMENTS

| | | | |
|---|---|---|---|
| 1,031,401 | 7/1912 | Tirrill | 24/128 R |
| 3,788,492 | 1/1974 | Kraft | 403/321 X |
| 3,811,582 | 5/1974 | Shumaker et al. | 214/138 |
| 3,921,835 | 11/1975 | Baker et al. | 414/694 |
| 3,955,851 | 5/1976 | Umeda et al. | 298/17 B |
| 4,184,803 | 1/1980 | Housman | 414/694 |
| 4,225,282 | 9/1980 | Nordstrom et al. | 414/694 |
| 4,370,090 | 1/1983 | Shumaker et al. | 414/694 |

*Primary Examiner*—Robert J. Spar
*Assistant Examiner*—Donald W. Underwood
*Attorney, Agent, or Firm*—Charles E. Lanchantin, Jr.

[57] ABSTRACT

A vehicle boom lock is disclosed for holding a boom assembly in a retracted transport position on an implement carrying swing frame. The boom lock includes a slotted coupling joint on the swing frame, and a deflectable cable assembly which extends cantileverably from the boom assembly for automatically interlockingly engaging the slotted coupling joint in response to pivotal movement of the boom assembly to the retracted position. A release mechanism can be manually manipulated from an operator station to conveniently disengage the cable assembly from the slotted coupling joint.

7 Claims, 5 Drawing Figures

44
52
60
46
58
10
38
43
48
CG
67
32
12
68
62
56
54
40
64
50
18
66
70
76
42
20
72
102
22
16
26
14
30
28
36
34
20
24
22

VEHICLE BOOM LOCK

This is a continuation of Ser. No. 501,401, filed June 6, 1983, now abandoned.

TECHNICAL FIELD

This invention relates generally to a structure for carrying a boom on a vehicle, and more particularly to an effective, releasable lock for automatically interlocking the boom to a vehicle frame member.

BACKGROUND ART

A considerable number of releasable backhoe boom locks have been used that do not rely upon fluid pressure in the rams for locking a boom to a frame member and enabling the transport thereof in a positive retracted position. Examples of the prior art are shown in U.S. Pat. Nos. 3,811,582 issued to J. F. Shumaker, et al on May 21, 1974; 3,921,835 issued to D. C. Baker, et al on Nov. 25, 1975; 4,184,803 issued to R. D. Housman on Jan. 22, 1980; and 4,225,282 issued to W. A. Nordstrom, et al on Sept. 30, 1980. However, even though some of these devices have been at least partially successful they have had individual drawbacks.

The boom locks disclosed in aforementioned U.S. Pat. No. 3,811,582 require pivotal or guidable latching members that are resiliently biased toward one position by a separate spring. This unnecessarily adds complexity and cost, and lowers the degree of positive reliability required in the relatively harsh working environment of an earthworking vehicle. Moreover, there is no provision for the convenient adjustment of the distance between the latch and pin members to compensate for manufacturing tolerances or wear.

In aforementioned U.S. Pat. No. 3,921,835 a horizontally pivoted ring structure and cooperating spring biasing means is utilized to enable coupling of the ring structure over an upstanding pin and locking of the boom to a swing frame member. Hence, this construction exhibits generally the same deficiencies as discussed above with respect to Pat. No. 3,811,582.

Likewise, the boom locks of U.S. Pat. Nos. 4,184,803 and 4,225,282 are more complex and costly than desired, and are more easily subject to adjustment problems and possible malfunction because of the number of pivot pin joints, springs and attachment brackets which are required.

In view of the above, it would be advantageous to provide a less complex and yet reliable releasable lock for automatically locking a boom to a frame in response to pivotally retracting the boom to its transport position. Also, in addition to allowing the convenient manual release of the lock from the operator station, the boom lock should be easily longitudinally adjustable and be capable of ready incorporation on existing vehicles with a minimum of modification thereof.

The present invention is directed to overcoming one or more of the problems as set forth above.

DISCLOSURE OF THE INVENTION

An implement carrying swing frame is coupled to the support of a vehicle by a first pivot pin apparatus, and an elevatable boom assembly is connected to the swing frame by a second pivot pin apparatus. In accordance with one aspect of the present invention a boom lock is provided having a coupling joint connected to the swing frame, and a cable assembly including a cable cantileverably connected to the boom assembly for engaging the coupling joint upon retracting pivotal movement of the boom assembly generally to a retracted transport position and for subsequently preventing extending pivotal movement of the boom assembly generally from the transport position as a result of interlocking engagement with the coupling joint.

More specifically, in the illustrated embodiments, a cable assembly extends cantileverably from the boom assembly and into interlocking engagement with a slotted upstanding member located adjacent to the upright axis of the pivot pin apparatus connecting the swing frame to the vehicle main frame. Advantageously the proximal end of the cable assembly is screwthreadably received in the boom assembly for ease of longitudinal adjustment, and a release mechanism includes an elevatable element for deflecting the distal end of the cable assembly upwardly to an unlocking disposition with respect to the slotted member.

BEST MODE FOR CARRYING OUT THE INVENTION

Figure 1:
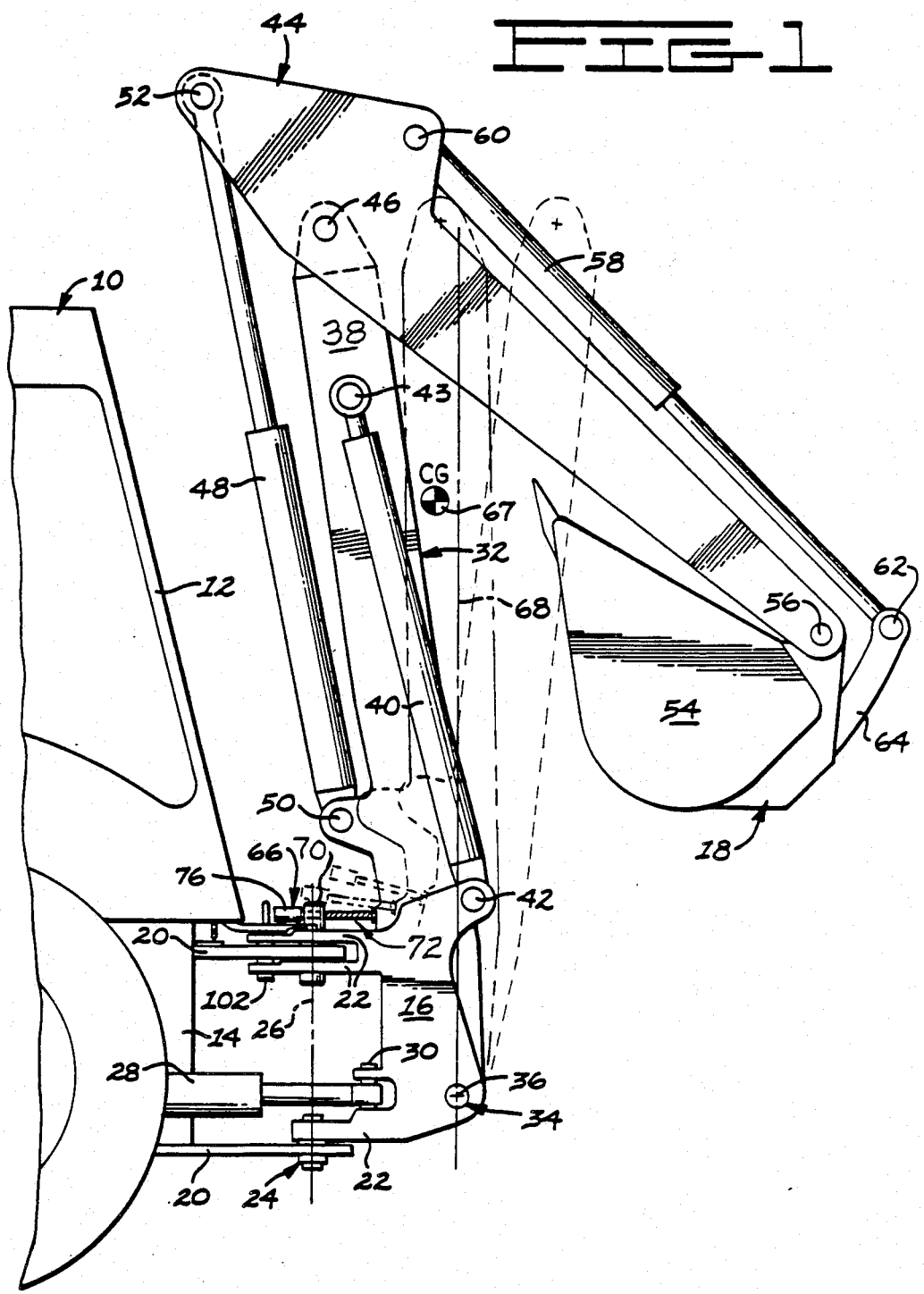
FIG. 1 is a diagrammatic, side elevational view of a rear portion of a back-hoe type vehicle incorporating a boom lock constructed in accordance with a first embodiment of the present invention and showing a boom and a cable assembly in a retracted solid line position, in an intermediate phantom line position, and a rearward broken line position.

Referring initially to FIG. 1, a vehicle 10 is illustrated as having an operator's station 12, a support or main frame 14, a swing frame 16 pivotally connected to the rear of the main frame, and an earthmoving implement or backhoe mechanism 18 pivotally connected to the swing frame. The main frame includes a pair of rearwardly extending plate members 20 which are suitably interleaved with a plurality of forwardly extending plate members 22 on the swing frame 16. These respective plate members are pivotally connected together by a first pivot pin apparatus 24 having an upright or substantially vertical axis 26. A pair of telescoping hydraulic rams or jacks 28 extend from the main frame to a coupling joint 30 located at either side of the swing frame for adjusting the angular disposition of the backhoe mechanism relative to the longitudinal axis of the vehicle.

The backhoe mechanism 18 includes a boom assembly 32 which is elevatably mounted on the swing frame 16 by a second pivot pin apparatus 34 defining a generally horizontal axis 36. The boom assembly 32 has a boom 38, and a pair of hydraulic rams or jacks 40 which extend upwardly from corresponding pivot joints 42 on the opposide sides of the swing frame to a pair of pivot joints 43 on the opposite sides of the boom for lowering the boom about the axis 36 from an upright position to the desired working angle.

A stick assembly 44 is pivotally connected to the upper end of the boom assembly 32 at a pivot joint 46, and a hydraulic ram or jack 48 extends upwardly from a coupling joint 50 on the front inside surface of the boom 38 to a front coupling joint 52 on the stick assembly for manipulating it through the desired working angles in the usual manner. A backhoe bucket 54 is selectably pivoted at 56 to the other end of the stick assembly by another ram or jack 58 pivotally interconnected between a joint 60 on the stick assembly and a joint 62 on an arm 64 extending from the rear of back face part of the bucket.

It is to be understood that the physical disposition of the swing frame 16, the boom 38, the stick assembly 44 and the backhoe bucket 54 are determined by supplying pressurized hydraulic fluid to the respective rams 28, 40, 48 and 58 in a conventional manner.

In accordance with a first embodiment of the present invention a boom lock 66 is provided at the top of the swing frame 16 for positively maintaining the boom assembly 32 in a retracted position, and whereat the center of gravity 67 of the backhoe mechanism 18 is preferably disposed in an over-center disposition forwardly or inwardly of a vertical plane 68 through the axis 36 of the second pivot pin apparatus 34 as is diagrammatically illustrated in FIG. 1. Basically, the boom lock 66 includes a slotted coupling joint 70 connected to the swing frame 16, and a cable assembly 72 cantileverably connected to a front face of the boom assembly 32 and interlockingly engaged in the slotted coupling joint.

Figure 2:
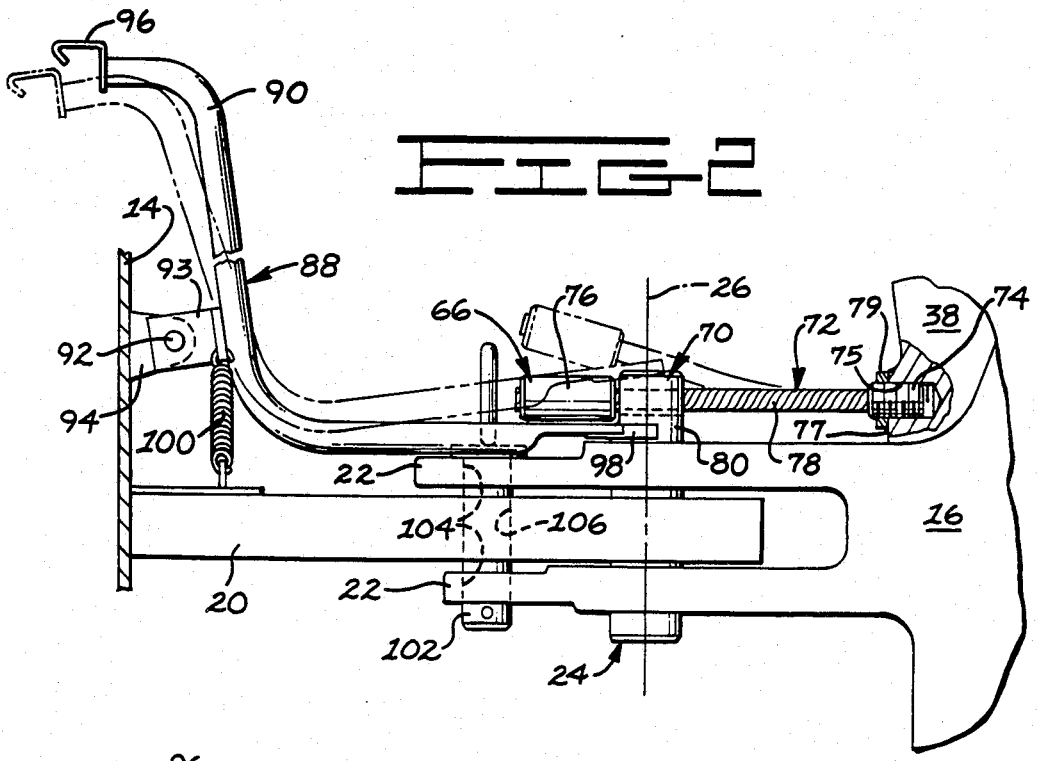
FIG. 2 is an enlarged, diagrammatic, side elevational view of the boom lock region illustrated in FIG. 1.
Figure 3:
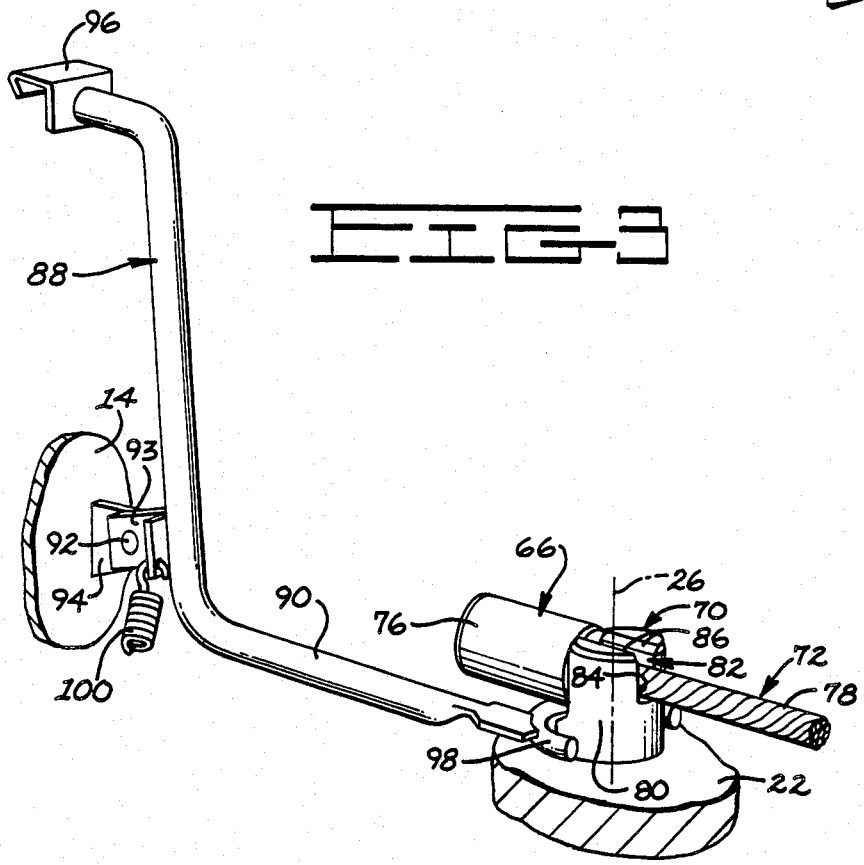
FIG. 3 is a diagrammatic perspective elevational view of the boom lock and associated release mechanism of FIGS. 1 and 2 better showing details of construction thereof.

As shown best in FIGS. 2 and 3, the cable assembly 72 includes first and second end portions 74,76 and a stiff, but deflectable cable 78 connecting the opposite end portions. The first or proximal end portion 74 is generally an externally threaded cylinder which is screwthreadably connected to a threaded bore 75 opening outwardly on a front face or inwardly facing central portion 77 of the boom 38 and is swaged or otherwise secured to the cable. A jamming lock 79 is screwthreadably mounted on the proximal end portion for holding the cable assembly in the proper longitudinal position. The second or distal end portion 76 is a simple cylinder also swaged or positively secured to the cable.

The slotted coupling joint 70 includes an upstanding member or cylindrical pin 80 which forms a part of the first pivot pin apparatus 24 and which is aligned with the upstanding axis 26. The pin 80 has an upwardly facing recess 82 of preselected profile therein as best shown in FIG. 3. Specifically, the recess 82 is defined by a slot 84 slightly wider than the cable 78 and narrower than the distal end portion 76, and a guide surface 86 located at each side of the slot which collectively serve to cradle and direct the distal end portion 76 of the cable assembly 72 forwardly and into a locking position when the boom is retracted as will hereinafter be explained. Each of these guide surfaces is preferably a 45° chamfer at the edge of the slot.

A boom lock release mechanism 88 is utilized to disengage the boom lock 66, and for this purpose incorporates a contoured lever arm 90 pivotally mounted to the vehicle frame 14 at a pivot joint 92 formed by a bracket 93 extending from the lever arm and a bracket 94 extending from the frame. The forwardmost portion of the lever arm extends generally longitudinally within the operator's station and is provided with a hand grip portion 96 that is conveniently accessible to the operator. The rear portion of the lever arm is external and is provided with a U-shaped release element 98 which underlies the distal end portion 76 of the cable assembly 72 in the locking disposition thereof. A resilient biasing element or spring member 100 is connected between the vehicle support 14 and the bracket portion of the lever arm to assure that it is biased into a lowered inactive position during normal operation of the vehicle.

As shown in FIG. 2, a lock pin 102 can be manually installed into bores 104,106 formed in the plate members 22,20 of the swing frame 16 and main frame 14 respectively when the bores are appropriately aligned by centering the swing frame 16 symmetrically on the central longitudinal axis of the vehicle 10 by proper manipulation of the rams 28 as can be visualized by reference to FIG. 1. In this embodiment the lever arm 90 is connected to one side of the U-shaped release element 98 as is illustrated in FIG. 3 in order to provide clearance from the lock pin 102 when it is installed.

INDUSTRIAL APPLICABILITY

In normal working operation of the backhoe mechanism 18, the boom assembly 32 is rotated in a clockwise manner about axis 36 from the retracted travelling position illustrated in FIG. 1 to a rearwardly extending working attitude. Thereafter the boom assembly is selectively raised or lowered by directing fluid under pressure to the desired end of the rams 40 as is well known in the art. During such working conditions the lock pin 102 is manually withdrawn from its position of securing the plate members 20,22 in longitudinal alignment.

When it is desired to move the vehicle to another job site, the swing frame 16 is preferably centered on the longitudinal axis by operation of the rams 28 and the lock pin 102 is preferably manually inserted in the bores 104,106 as is illustrated in FIG. 2. The stick assembly 44 is retracted by extending the ram 48, and the backhoe bucket 54 is retracted against the stick assembly by extending the ram 58 substantially as illustrated in FIG. 1. This places the center of gravity 67 of the backhoe mechanism 18 in a relatively favorable forward position. Thereafter the rams 40 are selectively manipulated to move the boom assembly 32 from its lowered rearwardly extending position through the rearward broken line position, the intermediate phantom line position, and substantially to the solid line elevated position illustrated with a velocity that positions the center of gravity forwardly or longitudinally inwardly beyond the vertical plane 68 and toward the fully retracted transport position.

During such retracting movement of the boom assembly 32 the cantilevered distal end portion 76 of the cable assembly 72 travels in an arc about the transverse axis 36 from the broken position to the intermediate phantom line position illustrated in FIG. 1 in such a way that the cylindrical external surface of the distal end portion initially engages the guide surfaces 86 on the upstanding member 80 since the distal end portion 76 is too large to fit within the slot 84 as can be appreciated by reference to FIG. 3. The distal end portion 76 travels forwardly along the guide surfaces 86 while subjecting the cable 78 to a continually increasing amount of arcuate deflection until the distal end portion extends forwardly beyond the pin member 80, whereupon the distal end portion drops and the cable drops positively and interlockingly into the slot 84.

In order to release the boom lock 66, the operator of the vehicle 10 can manually grasp the hand grip portion 96 shown in FIG. 2 and move it downwardly and forwardly to the phantom line position illustrated, whereupon the lever arm 90 pivots about joint 92 and the release element 98 is caused to move upwardly against the distal end portion 76 of the cable assembly 72. This action deflects the distal end portion 76 and the front end of the cable upwardly, and concurrently therewith the rams 40 can be selectively pressurized to urge the boom assembly 32 rearwardly such that the distal end portion 76 can travel rearwardly and outwardly to the right when viewing FIG. 2 above the guide surfaces 86 and out of the interlocking mode of operation. In the normal working position of the backhoe mechanism 18 the distal end portion extends forwardly in a cantilevered manner from the boom, but at a distance rearwardly spaced from the coupling joint 70 so that there is no interference.

It is thus apparent that the boom lock 66 is simple, reliable and of low cost. The cantileverably extending and flexible cable assembly 72 requires no separate spring therewith and can advantageously be longitudinally adjusted by the convenient screwthreading of the proximal end portion 76 into or out of the bore 75 in the boom 38, and by subsequently securing it in its proper position by jamming of the lock 79 against the face 77. This enables the proper interlocking disposition of the distal end portion 76 relative to the slotted coupling joint 70 to be obtained with the normal manufacturing tolerances and wear.

SECOND EMBODIMENT

Figure 4:
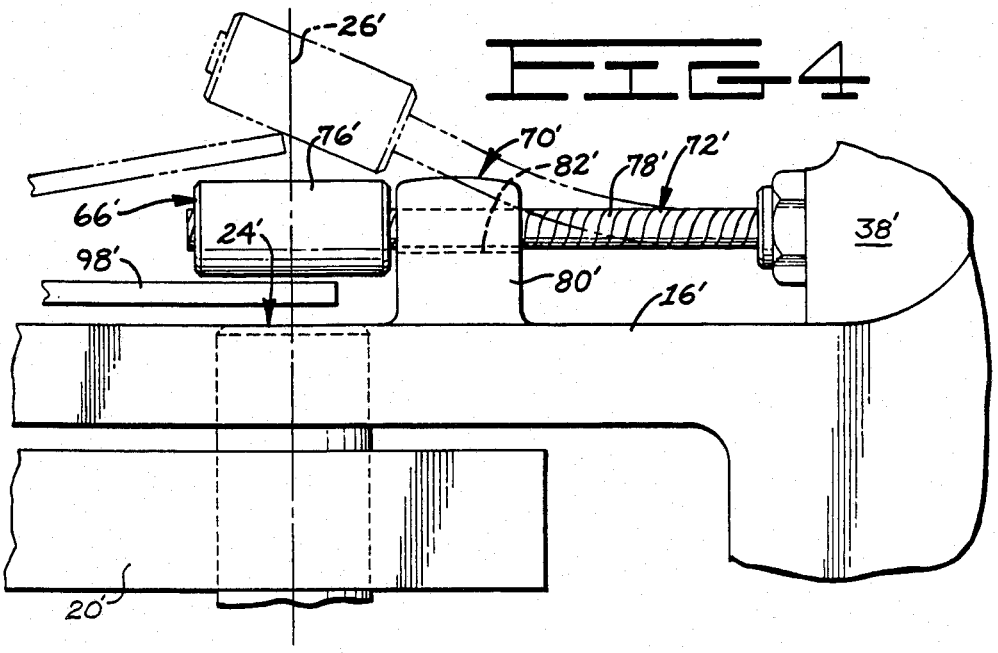
FIG. 4 is a fragmentary, diagrammatic, side elevational view of a second embodiment of the boom lock of the present invention.
Figure 5:
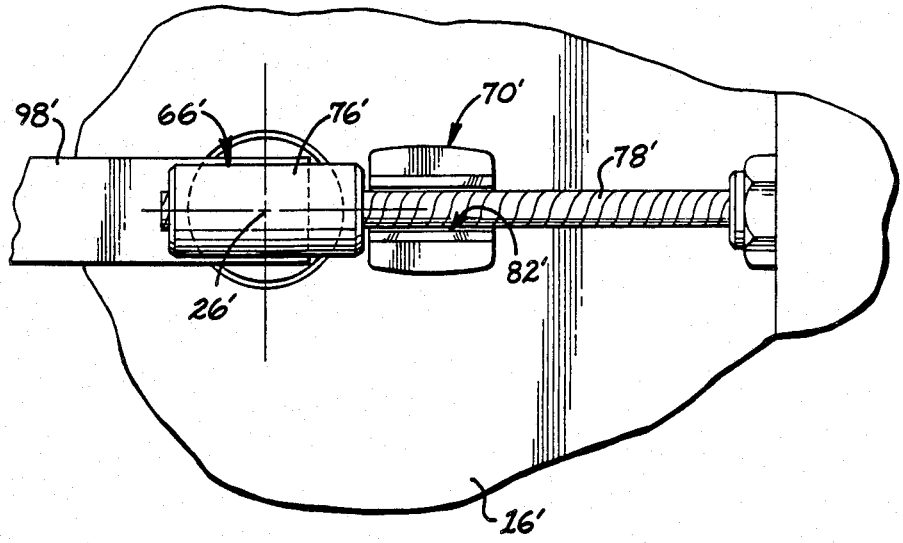
FIG. 5 is a fragmentary, top plan view of the second embodiment boom lock of FIG. 4.

A second embodiment of the present invention is illustrated in FIGS. 4 and 5, wherein elements similar to those described with respect to FIGS. 1 through 3 are identified by the same reference number with a prime indicator appended thereto.

The boom lock 66' shown in FIGS. 4 and 5 differs from the first embodiment by having the slotted coupling joint 70' and specifically the upstanding member 80' as an integral part of the swing frame casting 16'. Moreover, the upstanding slotted member 88' is located longitudinally rearwardly of the upright axis 26' of the recessed pivot pin apparatus 24' in such a location that in the locked position of the boom lock the distal end portion 76' is longitudinally centered on the axis 26'. Since it is so centered the release element 98' can be of relatively simple construction, and yet can be manually urged upwardly against the distal end portion 76' to permit the convenient release of the cable 78' from the recess 82' as described heretofore at any regular relationship of the swing frame 16' to the plate members 20'.

We have also contemplated fixedly securing the proximal end of the cantilevered cable assembly 72 to the swing frame 16, and connecting the coupling joint 70 to the boom assembly 32. But such construction is merely a reversal of the mountings illustrated in the preferred embodiments of the drawings.

Other aspects, objects and advantages will become apparent from a study of the specification, drawings and appended claims.

We claim:

1. In a vehicle of the type including a support and an implement carrying swing frame coupled to the support by a first pivot pin apparatus, and an elevatable boom assembly connected to the swing frame by a second pivot pin apparatus, a boom lock comprising:

a coupling joint connected to the swing frame; and cable assembly means for interlockably engaging the coupling joint upon retracting pivotal movement of the boom assembly generally to be retracted transport position and for subsequently preventing extending pivotal movement of the boom assembly generally from the transport position as a result of said interlocking engagement with the coupling joint, said cable assembly means including a stiff, but deflectable cable solely cantileverably connected to the boom assembly and an enlarged distal end portion.

2. The boom lock of claim 1 wherein the coupling joint includes an upstanding member having an upwardly facing recess adapted to receive the cable.

3. The boom lock of claim 2 wherein the distal end portion is connected to the cable and is larger than the recess, the distal end portion engaging the upstanding member and preventing extending pivotal movement of the boom assembly from the transport position.

4. The boom lock of claim 1 wherein the distal end portion is generally cylindrical in shape.

5. The boom lock of claim 4 wherein the cable assembly means includes means for screwthreadably adjusting the distance of the distal end portion from the boom assembly.

6. In a vehicle of the type including a support and an implement carrying swing frame coupled to the support by a first pivot pin apparatus having an upright axis, and an elevatable boom connected to the swing frame by a second pivot pin apparatus having a generally horizontal axis, a boom lock comprising:

an upstanding member defining an upwardly facing recess therein connected to the swing frame;

a cable assembly including a stiff, but deflectable cable and an enlarged distal end portion solely cantileverably connected to the boom, the cable assembly engaging the upstanding member upon retracting pivotal movement of the boom generally to a retracted transport position with the cable being received in the recess when the boom is in a retracted transport position; and release means for deflectably elevating the distal end portion above the upstanding member and thus the cable assembly from a position of interlocking engagement with the recess and permitting extending pivotal movement of the boom.

7. The boom lock of claim 6 wherein the cable assembly includes means for screwthreadably adjusting the cantilevered length of the cable assembly from the boom.

* * * * *